US007654656B2

(12) United States Patent
Umeda et al.

(10) Patent No.: US 7,654,656 B2
(45) Date of Patent: Feb. 2, 2010

(54) INK-JET RECORDING APPARATUS

(75) Inventors: Takaichiro Umeda, Nagoya (JP); Hiroaki Yazawa, Nagoya (JP); Hisaki Sakurai, Aichi-ken (JP); Hikaru Kaga, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 532 days.

(21) Appl. No.: 11/448,054

(22) Filed: Jun. 7, 2006

(65) Prior Publication Data

US 2006/0279612 A1 Dec. 14, 2006

(30) Foreign Application Priority Data

Jun. 8, 2005 (JP) ..... 2005-168201

(51) Int. Cl.
*B41J 2/175* (2006.01)

(52) U.S. Cl. ..... 347/85

(58) Field of Classification Search ..... 347/7, 347/84, 85

See application file for complete search history.

(56) References Cited

U.S. PATENT DOCUMENTS

| | | | | |
|---|---|---|---|---|
| 5,933,172 | A * | 8/1999 | Park et al. | 347/85 |
| 6,050,670 | A * | 4/2000 | Tooyama et al. | 347/29 |
| 6,206,511 | B1 * | 3/2001 | Cook et al. | 347/85 |
| 6,705,712 | B2 * | 3/2004 | Usui et al. | 347/86 |
| 6,824,241 | B2 * | 11/2004 | Sonnichsen et al. | 347/20 |
| 7,370,949 | B2 * | 5/2008 | Shiho et al. | 347/85 |

FOREIGN PATENT DOCUMENTS

JP 2004 9442 1/2004

* cited by examiner

*Primary Examiner*—Anh T. N. Vo
(74) *Attorney, Agent, or Firm*—Baker Botts L.L.P.

(57) ABSTRACT

A switching unit is provided near a tube for connecting an atmosphere communicating section of an ink cartridge to a charge tank. This switching unit comprises: a base; and a pressing mechanism arranged inside the base and capable of individually pressing tubes, so that the switching unit can apply the pressure from the charge tank and the tube pump selectively onto a plurality of the ink cartridges.

7 Claims, 4 Drawing Sheets

TO B
TO Y
TO C
TO M
TO ATOMOSPHERE
23
26
47
25
29
27
45
31
33
39
43
41
45a
39a
43a
41a
25a
39b
25b
41b
43b
45b
43c
45c
41c
39c
25c
43d
45d
41d
39d
25d
45e
43e
41e
25e
39e

INK-JET RECORDING APPARATUS

CROSS-REFERENCE TO RELATED APPLICATIONS

This Nonprovisional application claims priority under 35 U.S.C.§119(a) on Patent Application No. 2005-168201 filed in Japan on Jun. 8. 2005, the entire contents of which are hereby incorporated by reference.

BACKGROUND

The present invention relates to a technique for reducing the size of an ink jet recording apparatus.

In the prior art, an ink jet recording apparatus provided with a station type ink supply system has been known. That is, this type of ink jet recording apparatus includes: a carriage that carries a recording head for ejecting ink through an ejection nozzle and thereby performing recording on a recording medium and a sub-tank for storing ink supplied to the recording head; and a main tank for storing the ink supplied to the sub-tank. Then, when the amount of ink in the sub-tank decreases, a pump mechanism pressurizes the inside of the main tank so that the ink is supplied from the pressurized main tank to the sub-tank. Here, it should be noted that plural sets of the sub-tank, the main tank, and the pump mechanism described above are provided (see, for example; Japanese Patent Application Laid-Open No. 2004-9442 (pages 4 and 5 and FIG. 4).

SUMMARY

Nevertheless, the ink jet recording apparatus described above has a problem that when a pump mechanism is provided for each main tank, complexity arises in the structure for controlling the pump mechanisms while the size of the ink jet recording apparatus is increased.

In view of such a problem, it is therefore an object to provide a technique for reducing the size of an ink jet recording apparatus.

An ink jet recording apparatus according to a first aspect for the purpose of resolving the above-mentioned problem is characterized by an ink-jet recording apparatus provided with a plurality of main tanks for storing ink and with a recording head that is provided with a plurality of sub-tanks each for storing the ink supplied from each main tank and that selectively ejects the ink in each sub-tank through an ejection nozzle and thereby records an image onto a recording medium, comprising: a pressurization section for pressurizing the ink in said main tanks and thereby supplying the ink in said main tanks to said sub-tanks; and a switching unit for applying the pressure from said pressurization section selectively onto the plurality of main tanks.

According to the first aspect, the switching unit can apply the pressure from the pressurization section selectively onto the plurality of main tanks. This realizes a simpler configuration than the prior art one where a pressurization section has been provided for each sub-tank. Thus, size reduction is achieved in the ink jet recording apparatus.

The above and further objects and features will more fully be apparent from the following detailed description with accompanying drawings.

DETAILED DESCRIPTION OF THE EXEMPLARY EMBODIMENTS

The present embodiment is described below with reference to the drawings.

First Embodiment

Figure 1:
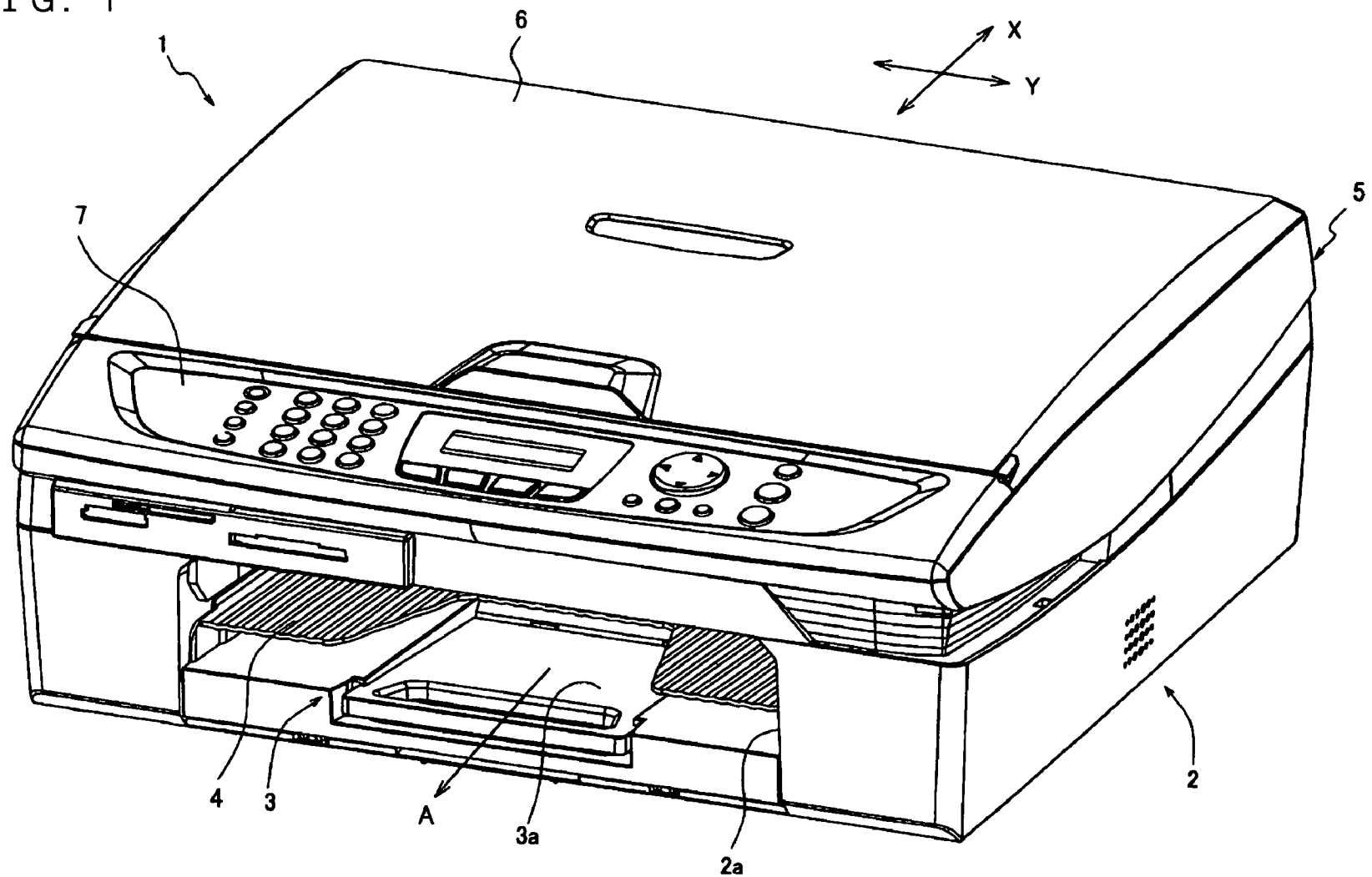
FIG. 1 is an outer shape perspective view of an ink jet recording apparatus 1 to which the present embodiment is preferably applicable.

FIG. 1 is an outer shape perspective view of an ink jet recording apparatus 1 to which the present embodiment is preferably applicable.

As shown in FIG. 1, the ink jet recording apparatus 1 is a so-called multi function device (MFD) provided with a printer function, a copy function, a scanner function, a facsimile function, and the like, and a sheet shaped medium composed of paper, plastic film, or the like is used as a recording medium.

The ink jet recording apparatus 1 is provided with a sheet paper cassette 3 which is located in the bottom part of a housing 2 composed of synthetic resin and which can be inserted through an opening 2*a* formed in the front part of the housing 2. Further, a paper discharge section 4 for receiving a recorded paper sheet conveyed in the direction indicated by an arrow A is provided over the sheet paper cassette 3. A sheet discharge opening which communicates with the paper discharge section 4 is provided in common in the upper part of the opening 2*a* in the front face of the housing 2.

The sheet paper cassette 3 can accommodate a plurality of paper sheets having been cut, for example, into the A4 size, the letter size, the legal size, or the postcard size. Each paper sheet is arranged such that its longer sides should be in parallel to the sheet conveyance direction (sub-scanning direction or X-axis direction). Further, at the front end of the sheet paper cassette 3, an auxiliary support member 3*a* for supporting the rear end part of a long paper sheet such as a legal size sheet is attached in an extendable manner in the X-axis direction. When paper sheets such as A4 size sheets that can completely be accommodated inside the sheet paper cassette 3 are used, the auxiliary support member 3*a* can be retracted relative to the front part of the sheet paper cassette 3 such as not to disturb sheet feeding.

On the other hand, in the upper part of the housing 2, an image reading device 5 is arranged that is used in manuscript reading when the copy function or the facsimile function is utilized. This image reading device 5 is constructed in a manner capable of being rotated and thereby opened and closed in the up and down directions about a pivot part (not shown) relative to one side-end part of the housing 2. Further, in the upper part of the image reading device 5, a manuscript cover body 6 for covering the upper surface of the image reading device 5 is attached in a manner capable of being rotated and thereby opened and closed in the up and down directions about a pivot (not shown) provided at the rear edge of the image reading device 5.

In image reading, the manuscript cover body 6 is opened upward. Then, a manuscript is placed on a placement glass plate. In this state, a contact image sensor (CIS) for manuscript reading provided under the placement glass plate in a manner capable of reciprocating motion in the Y-axis direction (main scanning direction) scans the manuscript paper, and thereby reads the image of the manuscript paper.

Further, an operation panel section 7 provided with various kinds of operation buttons and a liquid crystal display section is arranged in front of the manuscript cover body 6 provided in the upper surface of the image reading device 5.

In the inside of the housing 2, a recording unit (not shown) is provided that comprises: a carriage (not shown) that carries an ink jet type recording head 10 (see FIG. 2) for the purpose of implementing the printer function and that can perform reciprocating motion in the Y-axis direction (main scanning direction); and other mechanisms.

Figure 2:
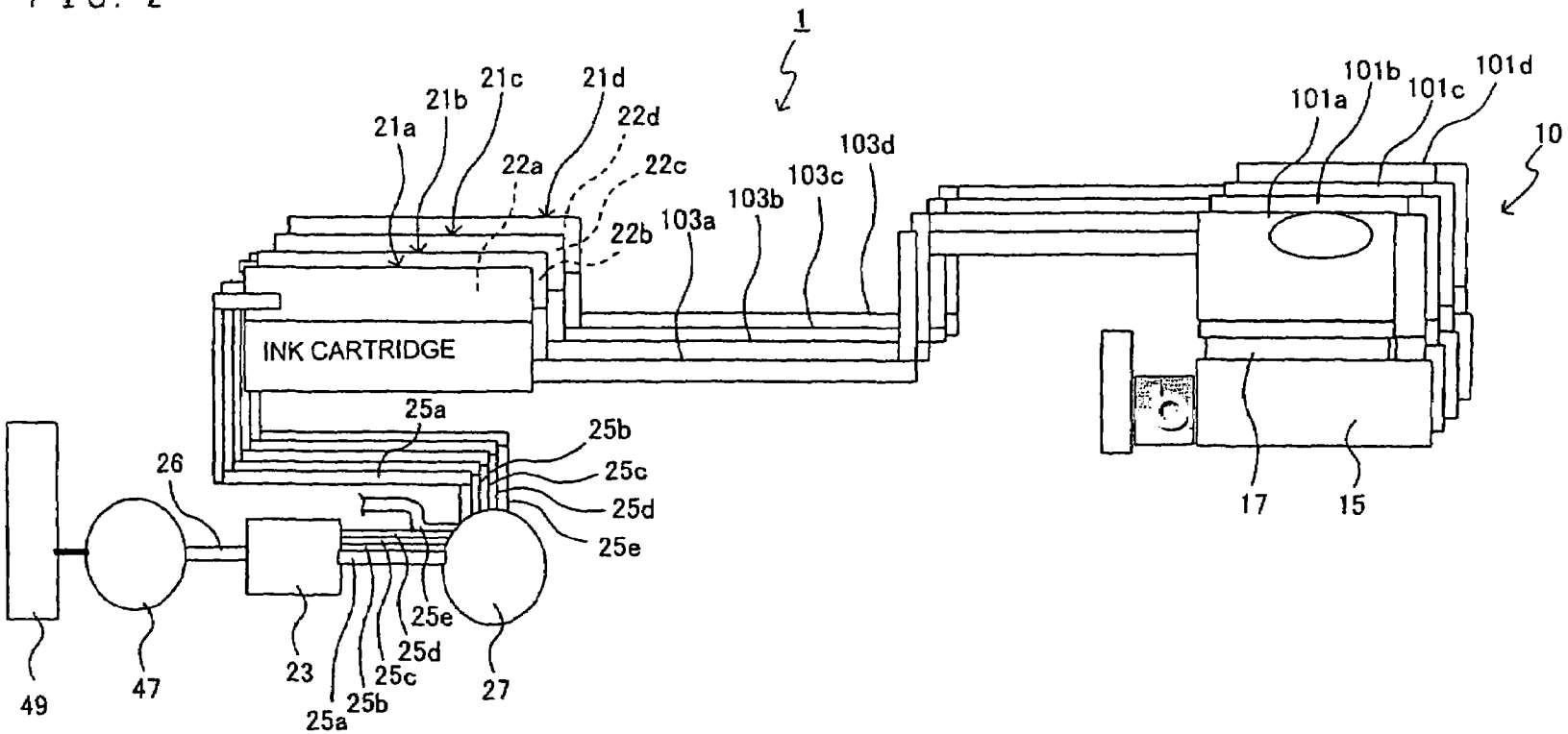
FIG. 2 is a block diagram showing schematic configuration of the principal part of a first embodiment of the ink jet recording apparatus 1 of the present embodiment.

FIG. 2 is a block diagram showing schematic configuration of the principal part of a first embodiment of the ink jet recording apparatus 1 of the present embodiment.

As shown in FIG. 2, in the recording head 10, four sets of ejection nozzles (not shown) are provided in a manner directing downward. Then, ink of four colors (black, cyan, yellow, and magenta) is ejected downward from these ejection nozzles, and thereby perform recording on a paper sheet.

Further, the recording head 10 carries sub-tanks 101*a*-101*d* for respectively storing ink of four colors supplied from ink cartridges 21*a*-21*d* described later. These sub-tanks 101*a*-101*d* are connected to the ejection nozzles through supply passages (not shown) for each color, so that ink of respective colors can be supplied from the sub-tanks 101*a*-101*d* to the ejection nozzles of respective colors.

Further, the sub-tanks 101*a*-101*d* are connected to the later-described ink cartridges 21*a*-21*d* through tubes 103*a*-103*d* for each color, so that ink of respective colors can be supplied from the ink cartridges 21*a*-21*d* to the sub-tanks 101*a*-101*d*.

In the recording unit constructed as described above, the carriage is controlled by a carriage control unit (not shown) composed of a CPU and the like, thereby performs reciprocating motion in the Y-direction (main scanning direction), and thereby causes the recording head 10 to scan. At the time of scanning, the recording head 10 selectively ejects ink in each sub-tank 101*a*-101*d* through the ejection nozzle, and thereby records an image onto a paper sheet.

Further, a maintenance unit 15 is mounted at a position corresponding to the waiting position of the carriage in the recording head 10. The maintenance unit 15 is provided with a cap 17 capable of sealing the ejection nozzles of the recording head 10. The maintenance unit 15 performs various kinds of maintenance operation including: wiping operation of wiping the ejection nozzles of the recording head 10 by using a blade or the like; and purging operation or flushing operation of forcedly removing dust, air, and solidified ink from the inside of the ejection nozzles, which is performed in a state that the cap 17 having come upward seals the ejection nozzles of the recording head 10.

Further, the housing 2 accommodates, in its inside, ink cartridges 21*a*-21*d* for respectively storing not-yet-used ink of four colors (black (K), cyan (C), magenta (M), and yellow (Y)) for full color recording. These ink cartridges 21*a*-21*d* are arranged successively in the movement direction of the carriage and can be attached from and detached to the above of the housing 2. When ink is to be loaded, the ink cartridges 21*a*-21*d* are changed individually. Further, in the ink cartridges 21*a*-21*d*, atmosphere communicating sections 22*a*-22*d* are respectively provided for establishing communication between the inside thereof and the atmosphere. Here, the ink cartridges 21*a*-21*d* correspond to the main tanks.

Further, the ink cartridges 21*a*-21*d* are respectively connected to a charge tank 23 through tubes 25*a*-25*d* (first tubes), so that the air under pressure accumulated in the charge tank 23 can be supplied from the charge tank 23 to each of the ink cartridges 21*a*-21*d*. Further, the atmosphere communicating sections 22*a*-22*d* of the ink cartridges 21*a*-21*d* are connected to a tube 25*e* (second tube) having one end which is open to the atmosphere. Specifically, the tube 25*e* branches into four in the middle thereof. Then, the end part branching into four of the two end parts of the tube 25*e* is connected respectively to the atmosphere communicating sections 22*a*-22*d* of the ink cartridges 21*a*-21*d*. Further, the non-branching end part of the two end parts of the tube 25*e* is open to the atmosphere so that the atmosphere communicating sections 22*a*-22*d* are connected to the atmosphere through the tube 25*e*. By virtue of this, the surplus air of the air under pressure supplied from the charge tank 23 to each of the ink cartridges 21*a*-21*d* can be emitted through the atmosphere communicating sections 22*a*-22*d* to the outside. Here, in FIG. 2, illustration is omitted for the branching part in the tube 25*e* as well as the connection parts between the atmosphere communicating sections 22*a*-22*d* and the tube 25*e*. Further, the above-mentioned tubes 25*a*-25*d* and non-branching part of the tube 25*e* are arranged in parallel to each other in the inside of a switching unit 27 described later, and fixed to a base 29 of a switching unit 27 (see FIGS. 3A and 3B).

Figures 3A, 3B:
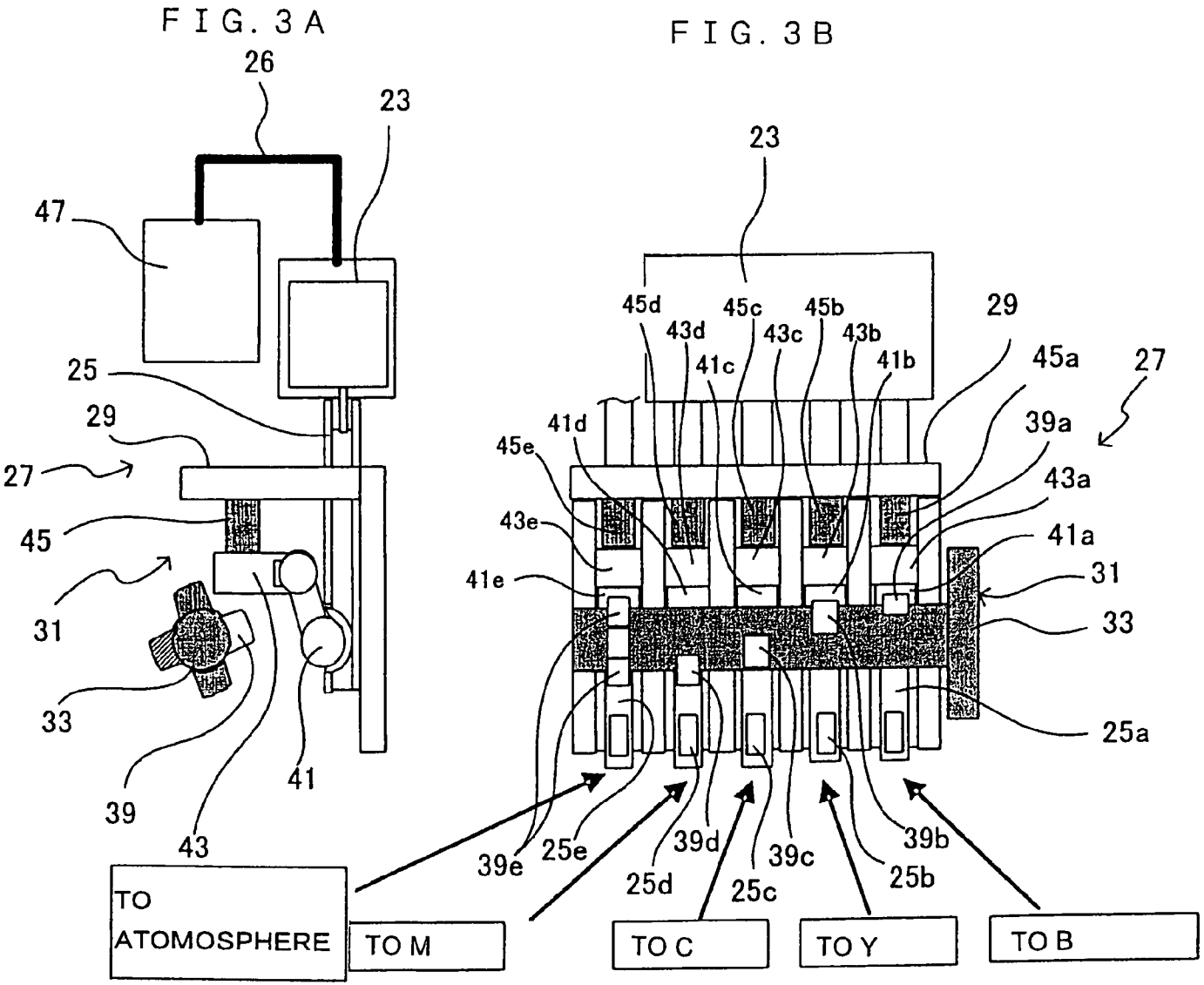
FIG. 3A is a side view of a switching unit 27.
FIG. 3B is a front view of the switching unit 27.

Further, a switching unit 27 is mounted in the vicinity of the tube 25*e* and the tubes 25*a*-25*d* for connecting the atmosphere communicating sections 22*a*-22*d* of the ink cartridges 21*a*-21*d* to the charge tank 23. As shown in FIGS. 3A and 3B, the switching unit 27 comprises: a base 29 serving as a housing; and a pressing mechanism 31 arranged inside the base 29 and capable of pressing the tubes 25*a*-25*e* individually. The pressing mechanism 31 comprises: a shaft 33 that intersects with the plurality of tubes; a switching driving section (not shown) capable of rotating the shaft 33; a switching control section (not shown) for controlling the switching driving section; protrusions 39*a*-39*e* each provided on the surface of the shaft 33 in a manner opposing each of the tubes 25*a*-25*e*; levers 43*a*-43*e*, a part of each of which is arranged on a trajectory of each of the protrusions 39*a*-39*e* moving in association with the rotation of the shaft 33, and the center part of each of which is supported in a rotatable manner by the base 29, and further one end of each of which serves as each of pressing sections 41*a*-41*e* capable of pressing each of the tubes 25*a*-25*e*; and springs 45*a*-45*e* respectively arranged in a state compressed between the base 29 and the other ends of the levers 43*a*-43*e*, and thereby biasing respectively the pressing sections 41*a*-41*e* of the levers 43*a*-43*e* toward the tubes 25*a*-25*e*. Here, in the side view of FIG. 3A, characters of "a-d" are omitted from the numerals indicating these components.

The above-mentioned protrusions 39*a*-39*d* (first protrusions) are arranged on the surface of the shaft 33 in such a manner as to successively contact with the levers 43*a*-43*d* corresponding to the ink cartridges 21*a*-21*d* of four colors when the shaft 33 is rotated by the switching driving section under control. Further, four of the protrusions 39*e* (second protrusion) are present and arranged on the surface of the shaft 33 in such a manner as to successively contact with the lever 43*e* when the shaft 33 rotates. It should be noted that each of surfaces of the protrusions 39*a*-39*d* which faces each of the tubes 25*a*-25*d* is larger than a surface of the protrusion 39*e* which faces the tube 25*e* (see FIGS. 4A to 4D).

Further, for the purpose of realizing: a "shut-off mode" where ink supply from the ink cartridge 21*a* to the sub-tank 101*a* is shut off, a "communicating mode" where ink is supplied from the ink cartridge 21*a* to the sub-tank 101*a*; and an "atmosphere communicating mode" where the inside of the ink cartridge 21*a* is allowed to communicate with the atmosphere, the protrusion 39*a* and the protrusions 39*e* are attached to the shaft 33 in such a manner satisfying the following requirements (i)-(iii).

Figure 4A:
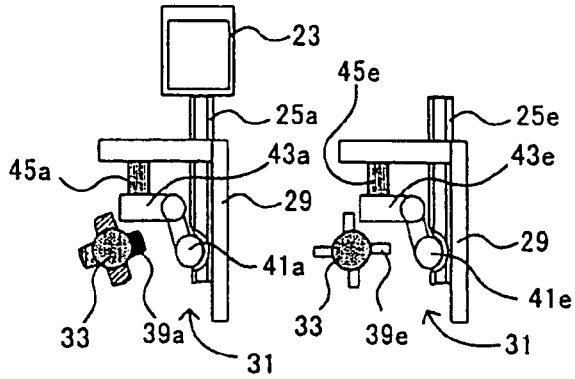
FIGS. 4A to 4D are diagrams showing the operation of the switching unit 27.

(i) When the shaft 33 is rotated, a state is realized that the protrusion 39*a* does not contact with the lever 43*a* while the protrusions 39*e* do not contact with the lever 43*e* (shut-off mode, see FIG. 4A).

Figure 4B:
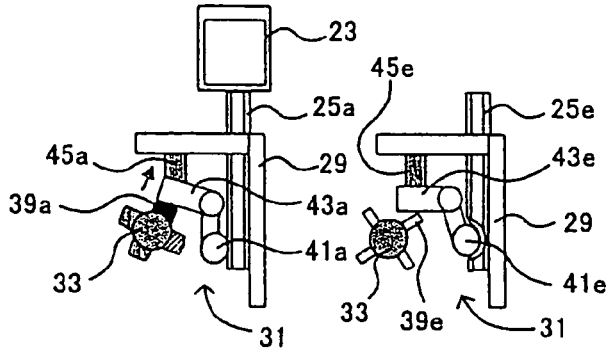

(ii) When the shaft 33 is rotated, a state is realized that the protrusion 39*a* contacts with the lever 43*a* while the protrusions 39*e* do not contact with the lever 43*e* (communicating mode, see FIG. 4B).

Figure 4C:
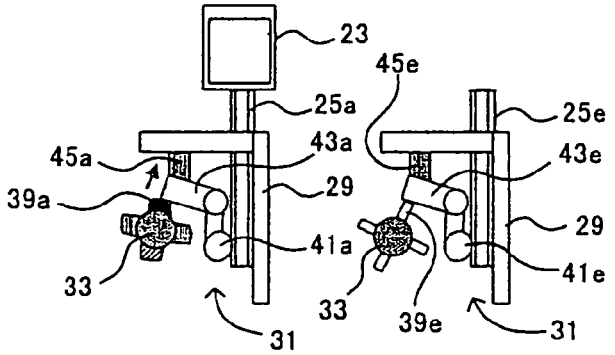
Figure 4D:
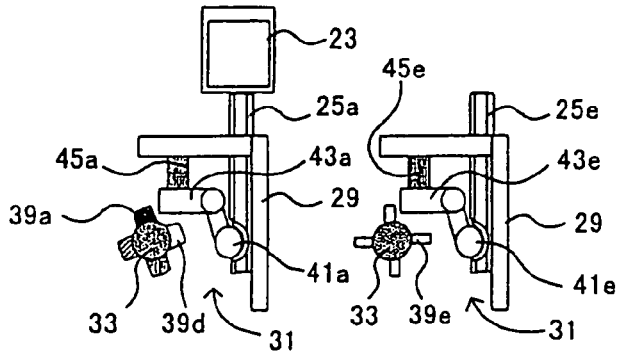

(iii) When the shaft 33 is rotated, a state is realized that the protrusion 39*a* contacts with the lever 43*a* while one of the protrusions 39*e* contacts with the lever 43*e* (atmosphere communicating mode, see FIG. 4C).

Here, as for the other combinations of the protrusion 39*b* and the protrusions 39*e*, the-protrusion 39*c* and the protrusions 39*e*, and the protrusion 39*d* and the protrusions 39*e*, the system is constructed such as to permit for each color the shut-off mode, the communicating mode, and the atmosphere communicating mode described above. However, detailed description is omitted here.

The switching unit 27 constructed as described above can control the pressing mechanism 31 for pressing the tubes 25*a*-25*e* individually, and thereby apply the pressure from the charge tank 23 selectively onto the ink cartridges 21*a*-21*d*.

Further, a tube pump 47 is connected to the charge tank 23 through a tube 26.

The charge tank 23 has the function of temporarily storing the air supplied from the tube pump 47 operated by a driving source 49, and thereby applying a fixed pressure onto the ink cartridges 21*a*-21*d*.

The charge tank 23 and the tube pump 47 which were constructed as described above pressurize the ink in the ink cartridges 21*a*-21*d*, and thereby supply the ink in the ink cartridges 21*a*-21*d* to the sub-tanks 101*a*-101*d*.

Here, the charge tank 23 and the tube pump 47 correspond to the pressurization section.

Next, the operation of the switching unit 27 of the ink jet recording apparatus 1 is described below with reference to FIGS. 4A to 4D. Here, the following description is given for the case of the ink of black color. Then, description is omitted for the cases of the ink of the other colors.

FIGS. 4A to 4D are diagrams showing the operation of the switching unit 27.

First, when ink supply from the ink cartridge 21*a* to the sub-tank 101*a* is to be shut off (shut-off mode, see FIG. 4A), the switching control section controls the switching driving section and thereby rotates the shaft 33 of the switching unit 27 until a state is realized that the protrusion 39*a* of the shaft 33 does not contact with the lever 43*a* while the protrusions 39*e* do not contact with the lever 43*e*. At that time, the pressing section 41*a* of the lever 43*a* presses the tube 25*a* owing to the biasing force of the spring 45*a*, while the pressing section 41*e* of the lever 43*e* presses the tube 25*e* owing to the biasing force of the spring 45*e*. As a result, the tube 25*a* and the tube 25*e* are closed. That is, air supply from the charge tank 23 to the ink cartridge 21*a* is shut off, while ink supply from the ink cartridge 21*a* to the sub-tank 101*a* is shut off.

Next, when ink is to be supplied from the ink cartridge 21*a* to the sub-tank 101*a* (BK communicating mode, see FIG. 4B), the switching control section controls the switching driving section and thereby rotates the shaft 33 of the switching unit 27 until a state is realized that the protrusion 39*a* of the shaft 33 contacts with the lever 43*a* while the protrusions 39*e* do not contact with the lever 43*e*. At that time, the protrusion 39*a* moves the lever 43*a* against the biasing force of the spring 45*a* so that the pressing section 41*a* of the lever 43*a* departs from the tube 25*a*, while the pressing section 41*e* of the lever 43*e* presses the tube 25*e* owing to the biasing force of the spring 45*e*. As a result, the tube 25*a* is opened, while the tube 25*e* is closed. That is, air supply from the charge tank 23 to the ink cartridge 21*a* is shut off, while ink is supplied from the ink cartridge 21*a* to the sub-tank 101*a*.

Further, when communication is to be established between the inside of the ink cartridge 21 a and the atmosphere (BK atmosphere communicating mode, see FIG. 4C), the switching control section controls the switching driving section and thereby rotates the shaft 33 of the switching unit 27 until a state is realized that the protrusion 39*a* of the shaft 33 contacts with the lever 43*a* while one of the protrusions 39*e* contacts with the lever 43*e*. At that time, the protrusion 39*a* moves the lever 43*a* against the biasing force of the spring 45*a* so that the pressing section 41*a* of the lever 43*a* departs from the tube 25*a*, while the protrusion 39*e* moves the lever 43*e* against the biasing force of the spring 45*e* so that the pressing section 41*e* of the lever 43*e* departs from the tube 25*e*. As a result, the tube 25*a* and the tube 25*e* are opened so that air is supplied from the charge tank 23 to the ink cartridge 21*a*. Then, the supplied air is released from the atmosphere communicating section 22*a* to the outside.

Then, when ink supply from the ink cartridge 21*a* to the sub-tank 101*a* is to be shut off again (shut-off mode, see FIG. 4D), the switching control section controls the switching driving section and thereby rotates the shaft 33 of the switching unit 27 until a state is realized that the protrusion 39*a* of the shaft 33 does not contact with the lever 43*a* while the protrusions 39*e* do not contact with the lever 43*e* as described above. At that time, the pressing section 41*a* of the lever 43*a* presses the tube 25*a* owing to the biasing force of the spring 45*a*, while the pressing section 41*e* of the lever 43*e* presses the tube 25*e* owing to the biasing force of the spring 45*e*. As a result, the tube 25*a* and the tube 25*e* are closed. That is, air supply from the charge tank 23 to the ink cartridge 21*a* is shut off, while ink supply from the ink cartridge 21*a* to the sub-tank 101*a* is shut off.

Here, in subsequent operation, when the switching control section controls the switching driving section and thereby rotates the shaft 33 of the switching unit 27, the above-mentioned three modes can be switched also for the other ink colors.

[Effects]

(1) As described above, according to the ink jet recording apparatus 1 of the first embodiment, the switching unit 27 can apply the pressure from the charge tank 23 and the tube pump 47 selectively onto the plurality of ink cartridges 21*a*-21*d*. This realizes a simpler configuration than the prior art one where a pressurization section has been provided for each sub-tank. Thus, size reduction is achieved in the ink jet recording apparatus 1.

(2) Further, according to the ink jet recording apparatus 1 of the first embodiment, the switching unit 27 can control the pressing mechanism 31 for pressing the tubes 25*a*-25*e* individually, and thereby apply the pressure from the charge tank 23 selectively onto the ink cartridges 21*a*-21*d*. Accordingly, the pressure from the charge tank 23 and the tube pump 47 can selectively be applied to the plurality of ink cartridges 21*a*-21*d* with a simpler configuration than a valve or the like for opening and closing the path provided in each of the tubes 25*a*-25*e*.

(3) Furthermore, according to the ink jet recording apparatus 1 of the first embodiment, the pressing mechanism 31 comprises: the shaft 33 that intersects with the plurality of tubes 25*a*-25*e*; and the protrusions 39*a*-39*e* formed on the surface of the shaft 33 in a manner respectively opposing the tubes 25*a*-25*e*. According to this configuration, when the shaft 33 is rotated, the state can be switched between a state that the tubes 25*a*-25*e* are squeezed by the protrusions 39*a*-39*e* and a state that the tubes 25*a*-25*e* are not squeezed by the protrusions 39*a*-39*e*. As a result, the pressure from the charge tank 23 and the tube pump 47 can selectively be applied to the plurality of ink cartridges 21*a*-21*d* with a much simpler configuration.

Other Embodiments

The present embodiment has been described above. However, the present embodiment is not limited to the above-mentioned embodiment, and may be implemented in the following various modes.

(1) In the first embodiment described above, the configuration has allowed the pressure from the charge tank 23 and the tube pump 47 to be applied selectively onto the plurality of ink cartridges 21*a*-21*d*. However, the present embodiment is not limited to this. That is, the configuration may allow switching between a "single color pressurization mode" where the pressure from the charge tank 23 and the tube pump 47 can be applied selectively to the plurality of ink cartridges 21*a*-21*d* as described above and an "all-color pressurization permitted mode" where the pressure from the charge tank 23 and the tube pump 47 is applied to all of the plurality of ink cartridges 21*a*-21*d*. In an example, in addition to the above-mentioned protrusions 39*a*-39*e*, four protrusions may be arranged on the surface of the shaft 33 in such a manner simultaneously contacting with the levers 43*a*-43*d* corresponding to the ink cartridges 21*a*-21*d* of four colors when the shaft 33 is rotated.

According to this-configuration, for example, when the "all-color pressurization permitted mode" is used, ink can be supplied simultaneously to the plurality of sub-tanks 101*a*-101*d*. On the other hand, when the "single color pressurization mode" is used, pressurization can be performed solely onto a sub-tank 101*a*-101*d* that requires ink charging. That is, the simple configuration can perform switching between the all-color pressurization permitted mode and the single color pressurization mode.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An ink jet recording apparatus comprising:

a plurality of main tanks for storing ink;

a recording head that is provided with a plurality of sub-tanks each for storing the ink supplied from each main tank and that selectively ejects the ink in each sub-tank through an ejection nozzle and thereby records an image onto a recording medium;

a pressurization section for pressurizing the ink in said main tanks and thereby supplying the ink in said main tanks to said sub-tanks;

a switching unit for applying the pressure from said pressurization section selectively onto the plurality of main tanks;

a plurality of tubes each for connecting each main tank to said switching unit; and a pressing mechanism comprising:

a shaft that intersects with said plurality of tubes; and protrusions each formed on the surface of said shaft in a manner opposing each tube, wherein said switching unit selectively applies the pressure onto the plurality of main tanks by means of the pressing mechanism for individually pressing said plurality of tubes.

2. The ink jet recording apparatus according to claim 1, wherein said pressing mechanism further comprises:

levers each for contacting with each of said protrusions; and springs each for biasing the lever toward said tube.

3. An ink jet recording apparatus comprising:

a plurality of main tanks for storing ink;

a recording head that is provided with a plurality of sub-tanks each for storing the ink supplied from each main tank and that selectively ejects the ink in each sub-tank through an ejection nozzle and thereby records an image onto a recording medium;

a pressurization section for pressurizing the ink in said main tanks and thereby supplying the ink in said main tanks to said sub-tanks;

a switching unit for applying the pressure from said pressurization section selectively onto the plurality of main tanks, a plurality of tubes each for connecting each main tank to said switching unit comprising:

first tubes each corresponding to each ink and for connecting each main tank to the pressurization section through said switching unit; and a second tube for communicating at least one main tank with the atmosphere through said switching unit, wherein said switching unit selectively applies the pressure onto the plurality of main tanks by means of a pressing mechanism for individually pressing said plurality of tubes, and wherein said pressing mechanism comprises:

a shaft that intersects with said plurality of tubes;

first protrusions each formed on the surface of said shaft in a manner opposing each first tube; and a second protrusion formed on the surface of said shaft in a manner opposing said second tube.

4. The ink jet recording apparatus according to claim 3, wherein said first protrusions and said second protrusion are arranged such that a position of each of said first protrusions differs from a position of said second protrusion in the axial direction of the shaft.

5. The ink jet recording apparatus according to claim 3, wherein each of surfaces of said first protrusions which faces each of the first tubes is larger than a surface of said second protrusion which faces the second tube.

6. The ink jet recording apparatus according to claim 3, wherein said first protrusions and said second protrusion are arranged such that a position of each of said first protrusions overlaps a position of said second protrusion partly in the axial direction of the shaft.

7. An ink jet recording apparatus comprising:

a plurality of main tanks for storing ink;

a recording head that is provided with a plurality of sub-tanks each for storing the ink supplied from each main tank and that selectively ejects the ink in each sub-tank through an ejection nozzle and thereby records an image onto a recording medium;

a pressurization section for pressurizing the ink in said main tanks and thereby supplying the ink in said main tanks to said sub-tanks;

a switching unit for applying the pressure from said pressurization section selectively onto the plurality of main tanks, a plurality of tubes each for connecting each main tank to said switching unit comprising:

first tubes each corresponding to each ink and for connecting each main tank to the pressurization section through said switching unit; and a second tube for communicating at least one main tank with the atmosphere through said switching unit, wherein said switching unit selectively applies the pressure onto the plurality of main tanks by means of a pressing mechanism for individually pressing said plurality of tubes, and wherein said switching unit is controlled so that switching is performed between: an all-color pressurization permitted mode in which said pressurization section applies the pressure onto all of said plurality of main tanks; and a single color pressurization mode in which said pressurization section applies the pressure onto any one of said plurality of main tanks.

* * * * *